US005410130A

United States Patent [19]

Braunstein

[11] Patent Number: 5,410,130

[45] Date of Patent: Apr. 25, 1995

[54] HEATING AND TEMPERATURE CYCLING

[75] Inventor: Zachary L. Braunstein, San Diego, Calif.

[73] Assignee: Ericomp, Inc., San Diego, Calif.

[21] Appl. No.: 230,291

[22] Filed: Apr. 20, 1994

[51] Int. Cl.[6] ..... H05B 3/30

[52] U.S. Cl. ..... 219/521; 219/386

[58] Field of Search ..... 219/521, 385, 386

[56] References Cited

U.S. PATENT DOCUMENTS

| | | | |
|---|---|---|---|
| 1,397,766 | 11/1921 | Lidberg | 219/521 |
| 2,653,214 | 9/1953 | Shaw | 219/521 |
| 2,784,287 | 3/1957 | Glynn | 219/543 |
| 2,932,718 | 4/1960 | Marsters | 219/521 |
| 3,109,084 | 10/1963 | Walsh | 219/521 |
| 3,634,651 | 1/1972 | Siegel | 219/521 |
| 4,504,733 | 3/1985 | Walsh | 219/521 |

*Primary Examiner*—Teresa J. Walberg
*Attorney, Agent, or Firm*—McAulay Fisher Nissen Goldberg & Kiel

[57] ABSTRACT

A heating element having a pair of terminals for being coupled to a source of electric current. The heating element includes a path arranged in a field having outer path elements and inner path elements. The outer path elements are in the form of at least one row of a repeated alternating wave of a first predetermined amplitude and pitch. The row substantially surrounding the perimeter of the field and the inner path elements is primarily in the form of a repeated alternating wave of a second predetermined amplitude and pitch. The second amplitude is substantially greater than that of the first amplitude and the second pitch is less than the first pitch. A sample heating device includes a base, four side walls extending from the base and a sample holding plate for holding sample vials. The sample holding plate, the base, and the side walls define a chamber. The sample vials are positioned within the chamber. The device also includes a first heating device for heating the chamber and the sample vials positioned therein. A temperature cycling apparatus includes a sample heating device as discussed above, and the sample heating device. The base of the sample heating device is positioned over the first fan and the first fan blows air toward the heating device.

13 Claims, 4 Drawing Sheets

HEATING AND TEMPERATURE CYCLING

BACKGROUND OF THE INVENTION

1. Field of the Invention

The present invention relates to heating and temperature cycling. More specifically, the present invention is drawn to an apparatus for heating samples and a temperature cycling apparatus incorporating the device for heating the samples.

2. Description of the Related Art

During the handling of various chemical samples, it is often necessary to heat the samples to effect a desired reaction or result. In addition, it is often desirable to subject the chemical samples to temperature cycling through a range of hot and cold temperatures.

Devices for heating chemical samples currently employ a solid block of aluminum having wells drilled therein to receive vials which hold chemical samples. The vials holding the samples are ordinarily made from a plastic such as polypropelene. The wells drilled in the aluminum block have close tolerances to the outer dimensions of the plastic sample vials so as to provide significant contact between the outer surfaces of the vials and the aluminum block. Furthermore, the tight tolerances reduce the losses in heat during transfer from the block to the vials and chemical samples.

The solid aluminum block is heated which, in turn, heats the chemical samples contained in the tubes that are positioned in the wells of the solid block. The aluminum block is heated using an electric heater having uniform heat dissipation. Due to the mass of the solid block, the electric heater requires a power rating of approximately 1000 Watts. The solid block arrangement provides for substantially uniform heating of the samples held therein.

When electric heating is employed, the heating element which is placed into contact with the solid aluminum block has decreased heat transfer characteristics near the edges of the electric heating element. As a result, the heat transferred to the solid block is not uniform and heating efficiency of the solid block is reduced. Furthermore, the current required to operate the electric heater is substantial, thus increasing operating costs.

In order to prevent evaporation of the samples contained in the plastic tubes, heated covers are placed over the plastic tubes. These covers are heated to a temperature which exceeds the temperature to which the samples contained in the tubes are heated. As a result, evaporation of the sample is prevented. However, since the tubes are normally filed to approximately $\frac{1}{3}$ of capacity, separation of the sample contained within the tube often occurs. More specifically, the sample travels up the walls of the plastic tube until it is repulsed by a higher temperature level. The greater the distance between the sample and the higher temperature gradient, the further the sample travels in the tube. As a result, therefore, the sample vials must be subjected to a centrifuge to gather the samples.

When the solid aluminum block is incorporated into a temperature cycling arrangement, the heated block containing the sample is normally immersed in a cold bath to reduce the temperature of the block and the chemical samples held therein.

The drawbacks associated with the solid block construction include high manufacturing cost, high weight, and complicated cooling methods to achieve acceptable cooling times. The high weight of the solid block also proves inconvenient if the solid block is to be placed in a cold bath to effect cooling.

Accordingly, it is an object of the present invention to provide a light weight sample holding device which provides good heat transfer characteristics to the samples held therein. It is a further object of the present invention to minimize separation of chemical samples held within tubes associated with the sample holding device. An additional objective of the present invention is to provide a light weight and small size temperature chamber to effect temperature cycling of chemical samples. It is also an object of the present invention to provide convenient and effective cooling of samples when subjected to temperature cycling. An added object is to provide an improved heating element construction which increases heat transfer characteristics near the edges of the heating element.

SUMMARY OF THE INVENTION

A heating element having a pair of terminals for being coupled to a source of electric current. The heating element includes a path arranged in a field having outer path elements and inner path elements. The outer path elements are in the form of at least one row of a repeated alternating wave of a first predetermined amplitude and pitch. The row substantially surrounding the perimeter of the field and the inner path elements is primarily in the form of a repeated alternating wave of a second predetermined amplitude and pitch. The second amplitude is substantially greater than that of the first amplitude and the second pitch is less than the first pitch.

A sample heating device includes a base, four side walls extending from the base and a sample holding plate for holding sample vials. The sample holding plate, the base, and the side walls define a chamber. The sample vials are positioned within the chamber. The device also includes a first heating device for heating the chamber and the sample vials positioned therein.

A temperature cycling apparatus includes a sample heating device as discussed above. The base of the sample heating device is positioned over the first fan and the first fan blows air toward the heating device.

For a better understanding of the present invention, reference is made to the following description and drawings, while the scope of the invention will be pointed out by the appended claims.

DESCRIPTION OF THE PREFERRED EMBODIMENT

Figure 1:
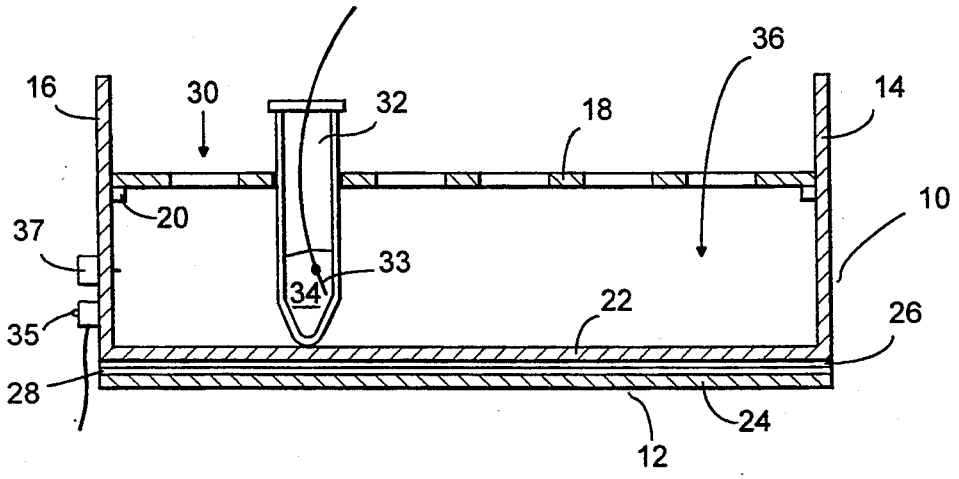
FIG. 1 is a cross-sectional view of a sample heating device according to the present invention.

Referring to FIG. 1, heating device 10 according to the present invention includes base portion 12, side walls 14, 16, sample holding plate 18, and positioning means 20 for positioning holding plate 18. In one embodiment side walls 14, 16 may be replaced by a cylindrical side wall portion. Accordingly, the external geometry of heating device 10 is not limited to that illustrated in FIG. 1.

Base portion 12 includes inner wall 22, outer wall 24, and heating element 26. Base portion 12 may also include thermo-conductive pad 28 which has a high coefficient of conductivity to increase uniformity of the heat dispersed by heating element 26. In one embodiment, thermo-conductive pad 28 has a thermal conductivity of approximately 3.85 W/(m.K). Preferably, heating element 26 is high pressure/high temperature glued to the bottom of inner wall 22. The temperature range at which heating element 26 operates is between ambient temperature and 140° C. Thermo-breaker switch 37 may be positioned in communication with chamber 36. The temperature limit of thermo-breaker switch 37 should be selected so that power is not provided to heating element 26 when it reaches a temperature near its upper limit. In one embodiment, the temperature limit of thermo-breaker switch 37 is selected, accounting for the temperature gradient within chamber 36, at approximately 110° C. Heating element 26 is also referred to herein as first heating means.

Preferably, heating device 10 is constructed from aluminum. To prevent warping of inner wall 22, bottom portion 12 is constructed as follows: inner wall 22 and outer wall 24 are constructed from AL5052; both inner wall 22 and outer wall 24 are approximately 0.06 inches thick; and, thermo-conductive pad 28 is approximately 0.007 inches thick.

Sample holding plate 18 includes a series of holes 30 for receiving and positioning vials 32 having chemical samples 34 therein. Sample holding plate 18 is positioned within heating device 10 by positioning means 20. Preferably, positioning means 20 permits horizontal positioning of sample holding plate 18 with respect to inner wall 22. Positioning means 20 may include pegs, clips, pins, screws, etc., which attach to side walls 14, 16. Furthermore, positioning means 20 may include standoffs connected to inner wall 22. Multiple sample holding plates 18 may be positioned within heating device 10.

Sample holding plate 18, side walls 14, 16 and inner wall 22 define chamber 36. Heating element 26 heats inner wall 22. Inner wall 22 heats sample vial 32 as a result of direct contact between the tip of sample vial 32 and inner wall 22. In addition, the air within chamber 36 is heated due to the heat which radiates from the surface of inner wall 22. Holes 30 in sample holding plate 18 are sized so as to have minimal space through which air within chamber 36 can escape once sample vials 32 are inserted therethrough. Accordingly, chamber 36 effectively operates as a heating chamber, with little heated air escaping through openings 30. Preferably, openings 30 are sized to a diameter which is approximately 0.003 inches to 0.005 inches larger than the outer diameter of sample vial 32.

By employing chamber 36, the weight of the heating device 10 is approximately one eighth of the weight of the solid block construction. Furthermore, the reduced weight of heating device 10 provides the operator with greater control over the temperature to which samples 34 are subjected.

The edges of heating element 26 are designed so that the density of the power dissipated near the edges is increased approximately 10% from the power dissipated near the center of heating element 26. The power dissipation density may be increased linearly, parabolically, or according to some other mathematical equation. The increased power dissipation density begins at a location a predetermined distance from the edges of heating element 26. The predetermined distance may be 20% of the distance measured between the center of heating element 26 and each edge. The maximum power dissipation density, therefore is adjacent the edges of heating element 26

Figure 2:
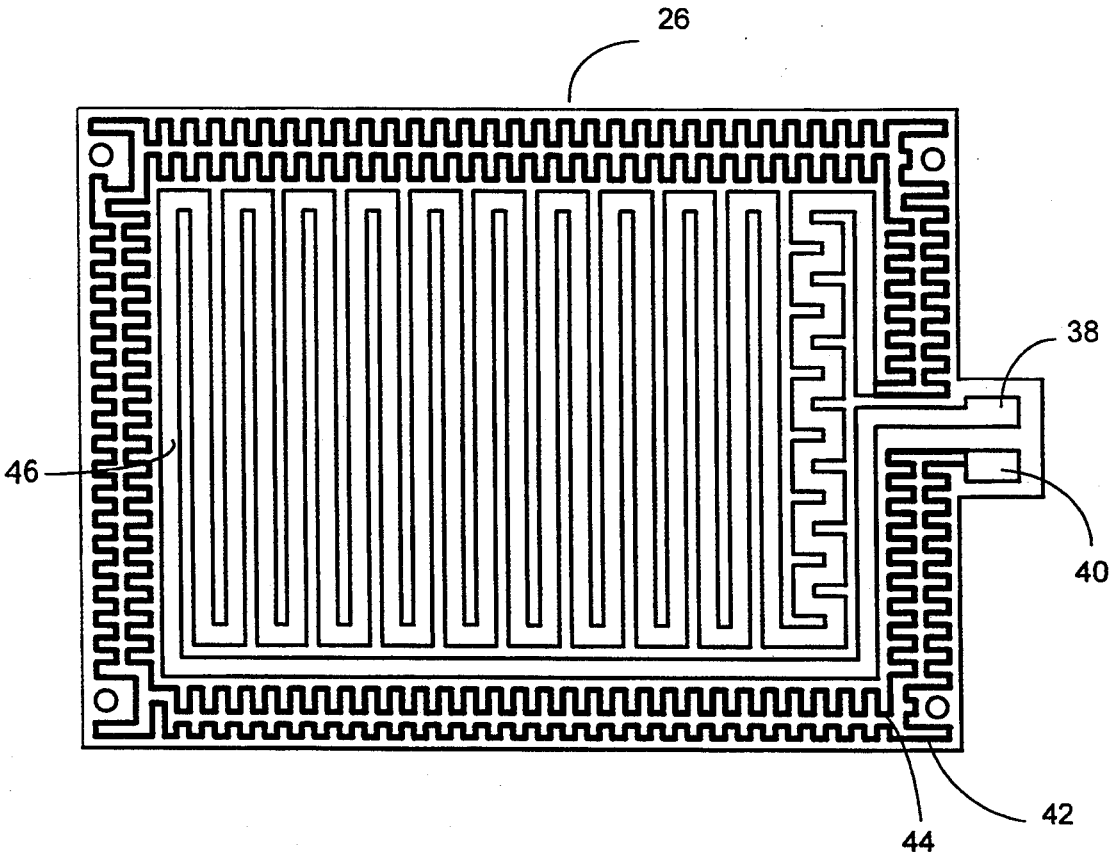
FIG. 2 is an illustration of a heating element which is incorporated into the base of the embodiment disclosed in FIG. 1.

Referring to FIG. 2, one embodiment of heating element 26 is shown in greater detail. Heating element 26 includes a pair of terminals 38, 40 for being coupled to a source of electric current (not shown). Heating element 26 has a path arranged in a field having outer path elements 42, 44 and inner path elements 46. The outer path elements 42, 44 are in the form of at least one row of a repeated alternating wave of a first predetermined amplitude and pitch. The row substantially surrounds the perimeter of the field. The inner path elements 46 are primarily in the form of a repeated alternating wave of a second predetermined amplitude and pitch. The second amplitude is substantially greater than that of the first amplitude and the second pitch is less than the first pitch.

Terminals 38, 40 may be connected to a power source (not shown) through thermo-breaker switch 37 to cause heating. Outer path elements 42 and 44, as illustrated in FIG. 2, increase heating along the edges of heating element 26 by approximately 10% from those heating elements which are generally available in the art. The power rating of heating element 26 is approximately 530 Watts. Heating element 26 may be constructed from KAPTON TM, or mica, silicone rubber. Preferably, element 26 is substantially flat.

Figure 3:
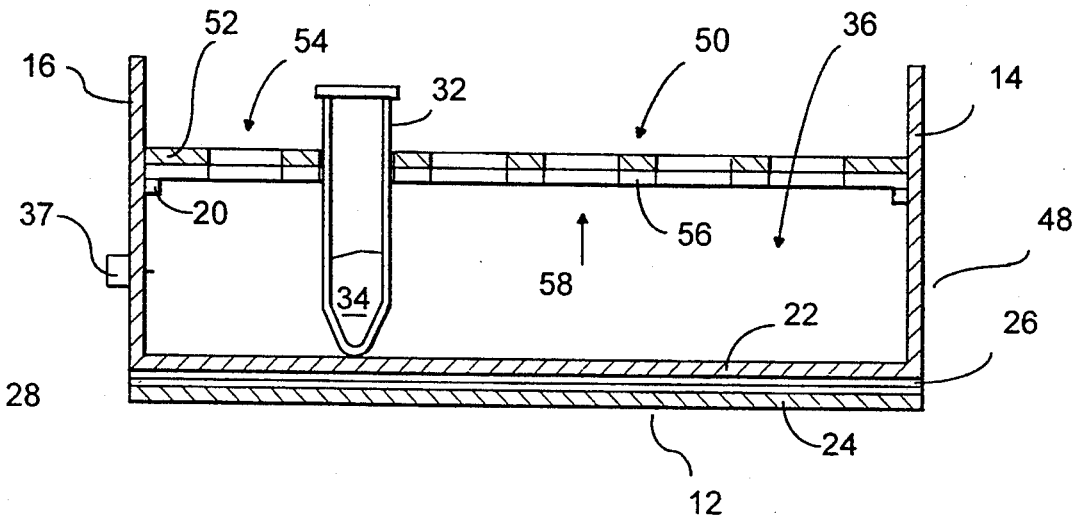
FIG. 3 is a view similar to FIG. 1, illustrating a sample heating device which includes a second heating element.

Referring to FIG. 3, heating device 48, according to a second embodiment of the present invention, is substantially similar to the device illustrated in FIG. 1. Accordingly, the identification numerals for elements previously described remain the same. The significant difference between the embodiment shown in FIG. 3 and that of FIG. 1 is that sample holding plate 18 of FIG. 1 has been replaced with sample holding plate 50 in the embodiment shown in FIG. 3. Sample holding plate 50 includes upper plate 52 having through holes 54 therein for receiving sample vials 32. Upper holding plate 52 may be constructed from AL5052 and may have a thickness of approximately 0.06 inches. Sample holding plate 50 also includes second heating element 56 having through holes 58 which align with through holes 54 of upper plate 52. The through hole pairs 54, 58 are for receiving sample vials 32. Second heating element 56 is also referred to herein as second heating means. Second heating element 56, similar to first heating element 26, provides increased heating at its periphery.

Sample holding plate 50 may be employed as an evaporation control device by maintaining the temperature of sample holding plate 50 at a temperature higher than the temperature of sample 34. In this fashion, therefore, a temperature gradient is created in chamber 36 whereby the temperature at sample holding plate 50 is maintained at a temperature which is approximately 10 degrees higher than that of sample 34. By providing the higher temperature above, but close to, the surface of sample 34, the travel of the sample 34 within sample vial 32 is reduced and the uniformity of sample 34 is maintained.

Thermo-breaker switch 37 may be connected in parallel to both heating element 26 and second heating element 56 to provide temperature range protection.

Positioning means 20 may be moveable within device 48 to adjust the positioning of sample holding plate 50. Accordingly, the distance between the surface of sample 34 and holding plate 50 may be adjusted as needed. Furthermore, it is conceivable that more than one sample holding plate may be positioned within device 48. In this fashion, therefore, sample holding plate 50 may be used to provide additional heating at a position below the surface of sample 34. A second sample holding plate may then be positioned above the surface of sample 34 to act as an evaporation control device. Since multiple chambers would be created, it is conceivable that thermo-breaker switches be provided in each chamber.

Figure 4:
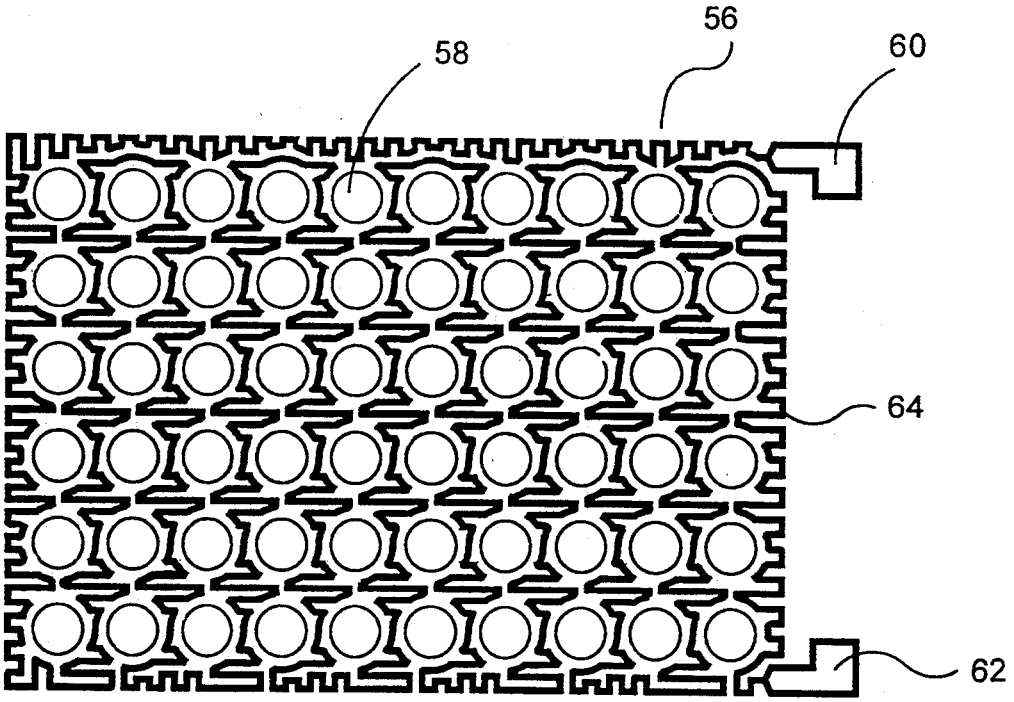
FIG. 4 is an illustration similar to FIG. 2, for the second heating element illustrated in FIG. 3.

FIG. 4 is an embodiment illustrating second heating element 56 having 60 wells for receiving 60 sample vials 32, each having a volume of 0.6 milliliters. Second heating element 56 includes terminals 60, 62 which are interconnected by conductive heating trace 64. The power rating of the embodiment shown in FIG. 4 is approximately 183 Watts. Second heating element 56 provides for uniformity and is capable of generating heat levels required to effect evaporation control.

Furthermore, due to the relatively small mass of heating device 48, a light weight heating device is provided. In addition, the operator may accurately control the temperature of the sample 34 while preventing evaporation of and reducing the travel of sample 34.

Figure 5:
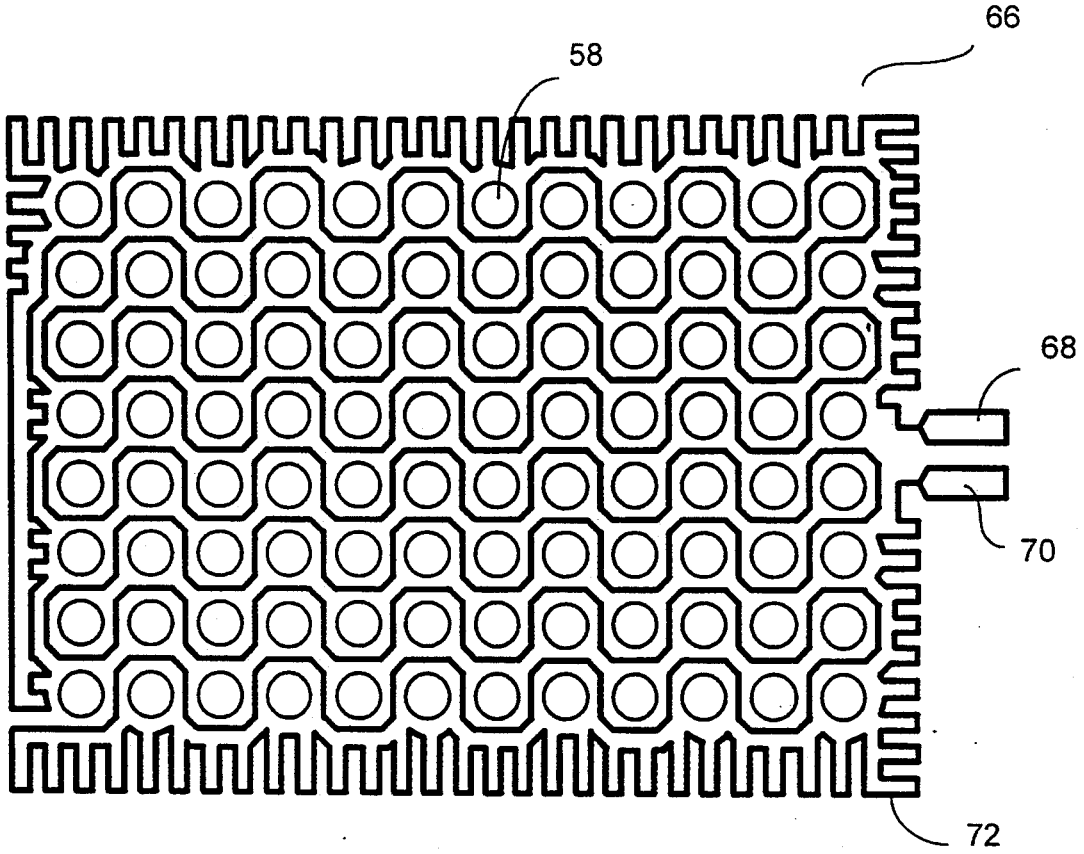
FIG. 5 illustrates an alternate embodiment to the second heating element disclosed in FIG. 4.

FIG. 5, illustrates an alternate second heating element 66 which provides for 96 wells for holding 96 sample vials 32, each having a volume of 0.2 milliliters. Second heating element 66 includes terminals 68, 70 which are interconnected by conductive heating trace 72. Heating element 66 has a power rating of approximately 180 Watts.

The heating speed of heating device 48 is approximately 10% faster than the heating speed of heating device 10, due to the incorporation of second heating element 56.

Figure 6:
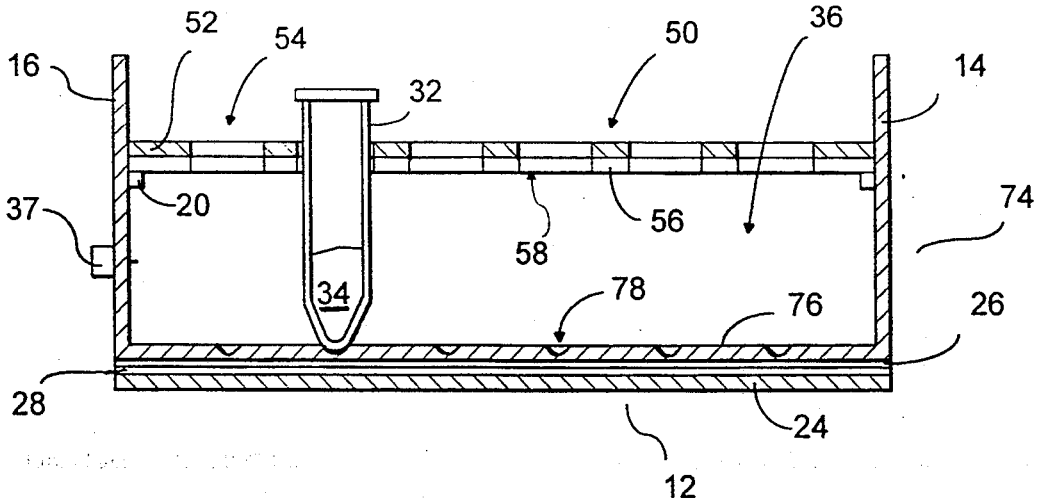
FIG. 6 is an embodiment similar to that shown in FIG. 3 and illustrates a modified base portion for receiving the tips of the sample vials.

FIG. 6 illustrates heating device 74 according to a third embodiment of the present invention. Heating device 74 is substantially similar to the embodiment illustrated in FIG. 3. Accordingly, the same identification numerals are employed for the elements previously described. Inner wall 22 of FIG. 3 has been replaced with inner wall 76 as illustrated in FIG. 6. Inner wall 76 includes indentations 78 for receiving the tips of sample vials 32. In this fashion, indentations 78 provide a larger surface area over which contact with the sample vials 32 is provided. Furthermore, the tips of sample vials 32, and therefore, samples 34 are positioned closer to heating element 26. As a result, increased heating efficiency is provided.

In one embodiment, inner wall 76 is constructed from 0.06 inch thick AL5052. Indentations 78 are contoured to receive tips of sample vials 32 and are approximately 0.02 inches deep.

Figure 7:
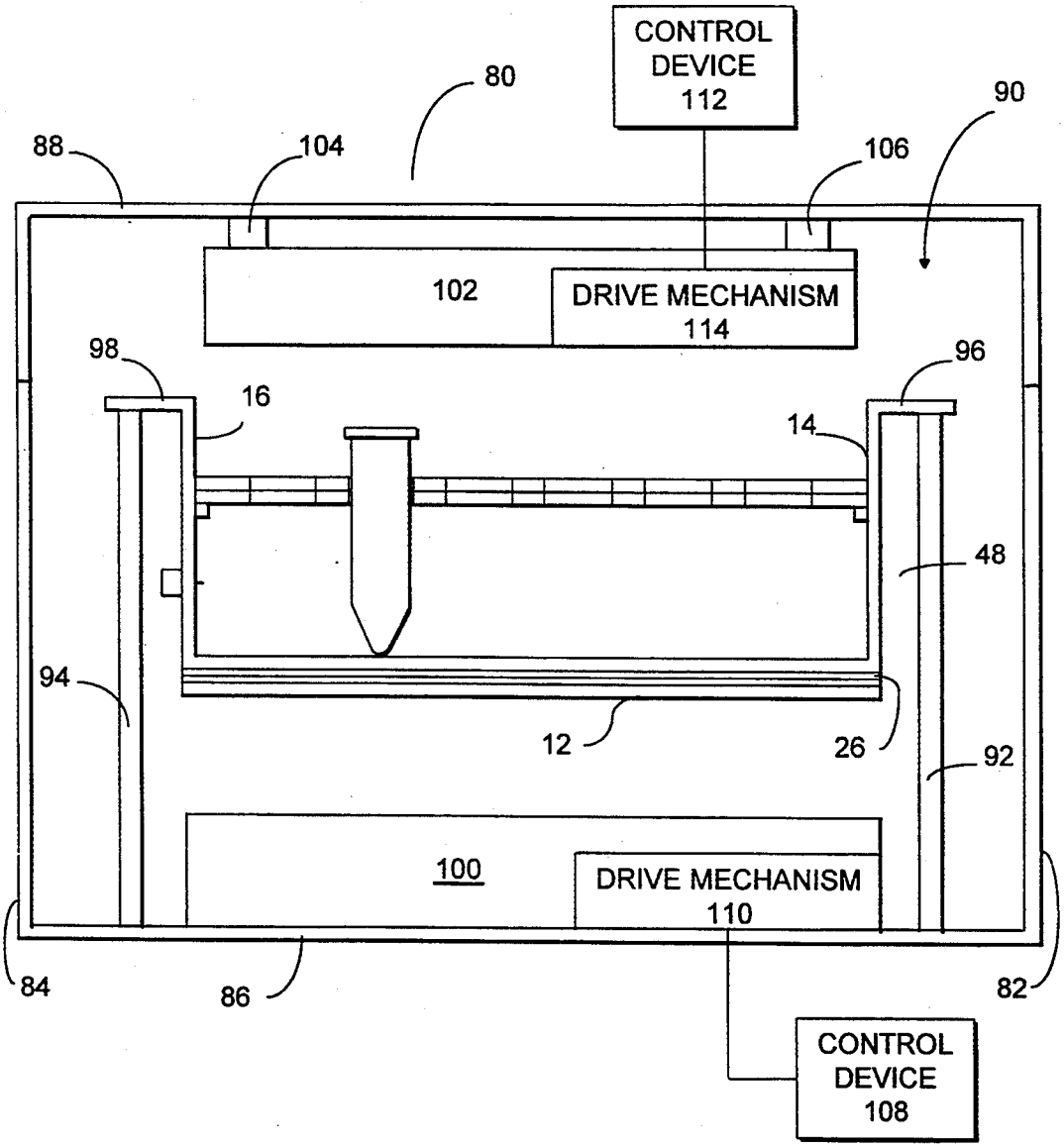
FIG. 7 illustrates a temperature cycling chamber according to the present invention which incorporates the sample heating device illustrated in FIG. 3.

FIG. 7 is an illustration of a temperature cycling chamber 80 which includes side walls 82, 84, base 86, and lid 88. Lid 88, sidewalls 82, 84 and base 86 define chamber 90. In an alternate embodiment, side walls 82, 84 may be replaced by a cylindrical side wall portion.

Heating apparatus 48, as disclosed in reference to FIG. 3, is suspended within chamber 90 by support members 92, 94. While heating apparatus 48 is used for discussion purposes, any of the heating devices disclosed herein may be employed with temperature cycling chamber 80. Support members 92, 94 are attached to extensions 96, 98 of side walls 14, 16, respectively. Heating apparatus 48 operates as previously disclosed. In order to effect temperature cycling, means for cooling the samples is included in temperature cycling chamber 80. First fan 100 is positioned below heating element 26 and, during operation, translates air into contact with bottom portion 12 to effect cooling. An air intake communicates with first fan 100 through base 86. Preferably, first fan 100 is rated at approximately 110 cubic feet/minute. First fan 100 is a component of first air circulation means which includes a control device 108 and a drive mechanism 110.

Second fan 102 may be provided to pull air from chamber 36. In addition, second fan 102 pulls air from chamber 90, around side walls 14, 16, to further cool heating apparatus 48. Fan 102 may be connected to lid 88 through connecting members 104, 106 so that the exhaust of second fan 102 circulates within chamber 90. Preferably, second fan 102 is rated at approximately 80 cubic feet/minute. Second fan 102 is a component of second air circulation means 110 which includes a control device 112 and a drive mechanism 114.

Fans 100, 102 provide a cooling speed in excess of 1.2° Celsius/second.

A control algorithm may be employed to monitor heating of samples 34 and chamber 36. Referring to FIG. 1, a thermocouple 33 may be inserted within sample vial 32 to provide information relating to the temperature of sample 34. The temperature data of sample 34 may be sent to a monitor or a central processing unit (not shown).

A second thermocouple 35 may be used to provide data relating to the temperature of chamber 36. Second thermo couple 35 may be of the washer type. The temperature data provided by second thermocouple 35 may be sent to a monitor or a central processing unit (not shown).

The central processing unit may employ a algorithm utilizing the data supplied by thermo couples 33, 35 to achieve the necessary energy during heating. As a result, rapid and accurate heating of sample 34 may be insured. The algorithm also controls the energy supplied to fans 100, 102 to control the cooling of sample 34.

EXAMPLES

A number of tests were performed on a variety of embodiments of the temperature cycling apparatus 80, including those which incorporate heating devices 10 and 48 to evaluate the heating and cooling speeds effected by apparatus 80.

1. The first device tested is constructed as a temperature cycling device 80 having only one fan 100 mounted on base 86 to effect cooling. The temperature cycling device incorporates a heating device substantially similar to that disclosed in FIG. 1. The temperature cycling device has a capacity of 60 sample vials, each having a volume of approximately 0.6 milliliters. The following results are obtained:

a) For a temperature range from 20° C. to 90° C., the heating speed obtained is 0.7° C./s, the cooling speed is 0.6° C./s, and the average temperature change rate is 0.65° C./s.

b) For a temperature range from 90° C. to 100° C., the heating speed obtained is 0.1° C./s, the cooling speed is 0.7° C./s, and the average temperature change rate is 0.4° C/s.

In sum, therefore, over a temperature range from 20° C. to 100° C., based on 10° C. increments, the heating and cooling speeds are:

$$\begin{array}{c} \text{HEATING} = ((7*0.7^\circ\ C./s) + (1*0.1^\circ\ C./s))/8 = 0.6^\circ\ C./s \\ \underline{\text{COOLING} = ((7*0.6^\circ\ C./s) + (1*0.4^\circ\ C./s))/8 = 0.6^\circ\ C./s} \\ \text{AVERAGE RATE OF} \\ \text{TEMPERATURE CHANGE} = 0.6^\circ\ C./s \end{array}$$

2. The second device tested is constructed as a temperature cycling device 80 having only one fan 100 mounted on base 86 to effect cooling. The temperature cycling device incorporates a heating device substantially similar to that disclosed in FIG. 3. Sample holding plate 50 is positioned approximately 0.1 inches from the tops of sample vials 32. The temperature cycling device has a capacity of 60 sample vials, each having a volume of approximately 0.6 milliliters. The following results are obtained:

a) For a temperature range from 20° C. to 90° C., the heating speed obtained is 0.8° C./s, the cooling speed is 0.6° C./s, and the average temperature change rate is 0.7° C./s.

b) For a temperature range from 90° C. to 100° C., the heating speed obtained is 0.5° C./s, the cooling speed is 0.6° C./s, and the average temperature change rate is 0.55° C./s.

In sum, therefore, over a temperature range from 20° C. to 100° C., based on 10° C. increments, the heating and cooling speeds are:

$$\begin{array}{c} \text{HEATING} = ((7*0.8^\circ\ C./s) + (1*0.5^\circ\ C./s))/8 = 0.8^\circ\ C./s \\ \underline{\text{COOLING} = ((7*0.6^\circ\ C./s) + (1*0.6^\circ\ C./s))/8 = 0.6^\circ\ C./s} \\ \text{AVERAGE RATE OF} \\ \text{TEMPERATURE CHANGE} = 0.7^\circ\ C./s \end{array}$$

3. The third device tested is constructed as a temperature cycling device 80 having fans 100, 102. Fan 102 was mounted approximately 0.05 inches from the tops of sample vials 32. Fan 102 has 1.0 inch diameter and is rated at 80 cubic feet/minute. The temperature cycling device incorporates a heating device substantially similar to that disclosed in FIG. 1. The temperature cycling device has a capacity of 60 sample vials, each having a volume of approximately 0.6 milliliters. The following results are obtained:

a) For a temperature range from 20° C. to 90° C., the heating speed obtained is 0.7° C./s, the cooling speed is 1.1° C./s, and the average temperature change rate is 0.8° C./s.

b) For a temperature range from 90° C. to 100° C., the heating speed obtained is 0.1° C./s, the cooling speed is 1.3° C./s, and the average temperature change rate is 0.7° C./s.

In sum, therefore, over a temperature range from 20° C. to 100° C., based on 10° C. increments, the heating and cooling speeds are:

$$\begin{array}{c} \text{HEATING} = ((7*0.7^\circ\ C./s) + (1*0.1^\circ\ C./s))/8 = 0.6^\circ\ C./s \\ \underline{\text{COOLING} = ((7*1.1^\circ\ C./s) + (1*1.3^\circ\ C./s))/8 = 1.1^\circ\ C./s} \\ \text{AVERAGE RATE OF} \\ \text{TEMPERATURE CHANGE} = 0.85^\circ\ C./s \end{array}$$

4. The fourth device tested is constructed as a temperature cycling device 80 having only one fan 100 mounted on base 86 to effect cooling. The temperature cycling device incorporates a heating device substantially similar to that disclosed in FIG. 1. The temperature cycling device has a capacity of 96 sample vials, each having a volume of approximately 0.2 milliliters. The following results are obtained:

a) For a temperature range from 20° C. to 90° C., the heating speed obtained is 0.8° C./s, the cooling speed is 0.7° C./s, and the average temperature change rate is 0.75° C./s.

b) For a temperature range from 90° C. to 100° C., the heating speed obtained is 0.5° C./s, the cooling speed is 0.8° C./s, and the average temperature change rate is 0.65° C/s.

In sum, therefore, over a temperature range from 20° C. to 100° C. based on 10° C. increments, the heating and cooling speeds are:

$$\begin{array}{c} \text{HEATING} = ((7*0.8^\circ\ C./s) + (1*0.5^\circ\ C./s))/8 = 0.8^\circ\ C./s \\ \underline{\text{COOLING} = ((7*0.7^\circ\ C./s) + (1*0.8^\circ\ C./s))/8 = 0.7^\circ\ C./s} \\ \text{AVERAGE RATE OF} \\ \text{TEMPERATURE CHANGE} = 0.75^\circ\ C./s \end{array}$$

5. The fifth device tested is constructed as a temperature cycling device 80 having only one fan 100 mounted on base 86 to effect cooling. The temperature cycling device incorporates a heating device substantially similar to that disclosed in FIG. 3. Sample holding plate 50 is positioned approximately 0.35 inches from the tops of sample vials 32. The temperature cycling device has a capacity of 96 sample vials, each having a volume of approximately 0.2 milliliters. The following results were obtained:

a) For a temperature range from 20° C. to 90° C., the heating speed obtained is 0.8° C./s, the cooling speed is 0.7° C./s, and the average temperature change rate is 0.75° C./s.

b) For a temperature range from 90° C. to 100° C., the heating speed obtained is 0.6° C./s, the cooling speed is 0.7° C./s, and the average temperature change rate is 0.65° C./s.

In sum, therefore, over a temperature range from 20° C. to 100° C. based on 10° C. increments, the heating and cooling speeds are:

$$\begin{array}{c} \text{HEATING} = ((7*0.8^\circ\ C./s) + (1*0.6^\circ\ C./s))/8 = 0.8^\circ\ C./s \\ \underline{\text{COOLING} = ((7*0.7^\circ\ C./s) + (1*0.7^\circ\ C./s))/8 = 0.7^\circ\ C./s} \\ \text{AVERAGE RATE OF} \\ \text{TEMPERATURE CHANGE} = 0.75^\circ\ C./s \end{array}$$

6. The sixth device tested is constructed as a temperature cycling device 80 having fans 100, 102. Fan 102 is mounted approximately 0.35 inches from the tops of sample vials 32. Fan 102 has a 1.0 inch diameter and is rated at 80 cubic feet/minute. The temperature cycling device incorporates a heating device substantially similar to that disclosed in FIG. 1. The temperature cycling device has a capacity of 96 sample vials, each having a volume of approximately 0.2 milliliters. The following results were obtained:

a) For a temperature range from 20° C. to 90° C., the heating speed obtained is 0.8° C./s, the cooling speed is 1.1° C./s, and the average temperature change rate is 0.9° C./s.

b) For a temperature range from 90° C. to 100° C., the heating speed obtained is 0.5° C./s, the cooling speed is 1.3° C./s, and the average temperature change rate is 0.9° C./s.

In sum, therefore, over a temperature range from 20° C. to 100° C., based on 10° C. increments, the heating and cooling speeds are:

$$\text{HEATING} = ((7*0.8^\circ\ C./s) + (1*0.5^\circ\ C./s))/8 = 0.8^\circ\ C./s$$
$$\underline{\text{COOLING} = ((7*1.1^\circ\ C./s) + (1*1.3^\circ\ C./s))/8 = 1.1^\circ\ C./s}$$
$$\text{AVERAGE RATE OF TEMPERATURE CHANGE} = 0.95^\circ\ C./s$$

While preferred embodiments of the present invention have been shown and described it will be understood by those skilled in the art that various changes and modifications could be made without varying from the scope of the present invention.

What is claimed is:

1. A sample heating device comprising:

an open container having a bottom portion and a side wall portion;

a sample holding plate disposed in a portion of said container, said plate having openings therein for receiving sample vials, said sample holding plate and said bottom portion and side wall portion of said container defining a chamber, said plate adapted to hold the sample vials so that a portion of each vial is positioned within the chamber; and first heating means for heating the chamber and the sample vials positioned therein by both conduction and radiation.

2. The sample heating device of claim 1 wherein said first heating means is affixed to said bottom portion of the container, the sample vials being positioned to contact said bottom portion.

3. The sample heating device of claim 2 wherein said first heating means includes a periphery, an inner portion, and means for providing greater heating capacity at said periphery than at said inner portion.

4. The sample heating device of claim 1 wherein said side wall portion comprises four side walls; wherein said bottom portion is substantially rectangular or square shaped and wherein said first heating means is substantially rectangular or square in shape and is affixed to said bottom portion.

5. The sample heating device of claim 1 further comprising regulating means for regulating the temperature within said chamber.

6. The sample heating device of claim 5 wherein said regulating means includes a thermoelectric switch, said thermoelectric switch for monitoring the temperature within the chamber and disconnecting power supplied to said first heating device when the temperature within the container exceeds a predetermined value.

7. A sample heating device comprising:

an open container having a bottom portion and a side wall portion;

a sample holding plate disposed in a portion of said container, said plate having openings therein for receiving sample vials, said sample holding plate and said bottom portion and side wall portion of said container defining a chamber, said plate adapted to hold the sample vials so that a portion of each vial is positioned within the chamber; and first heating means for heating the chamber and the sample vials positioned therein, wherein said first heating means is affixed to said bottom portion, the sample vials being positioned to contact said bottom portion, and wherein said first heating means includes a pair of terminals for being coupled to a source of electric current and a heating element, said heating element having a path arranged in a field having outer path elements and inner path elements, said outer path elements being in the form of at least one row of a repeated alternating wave of a first predetermined amplitude and pitch, said row substantially surrounding the periphery of the field, said inner path elements being primarily in the form of a repeating alternating wave of a second predetermined amplitude and pitch, said second amplitude being substantially greater than that of said first amplitude and said second pitch being less than said first pitch.

8. A sample heating device comprising;

an open container having a bottom portion and a side wall portion;

a sample holding plate disposed in a portion of said container, said plate having openings therein for receiving sample vials, said sample holding plate and said bottom portion and side wall portion of said container defining a chamber, said plate adapted to hold the sample vials so that a portion of each vial is positioned within the chamber;

first heating means for heating the chamber and the sample vials positioned therein; and a second heating means for heating said chamber, said second heating means being mounted to said sample holding plate for providing evaporation control.

9. The sample heating device of claim 8 wherein said bottom portion includes recesses for receiving tips of the sample vials positioned within the chamber.

10. The sample heating device of claim 8 wherein said second heating means includes openings corresponding to the openings of said sample holding plate and wherein said second heating means includes means for providing greater capacity heating at its periphery than at its inner portion.

11. The sample heating device of claim 10 wherein said second heating means includes a heating element which substantially surrounds each opening of said second heating means and wherein said element includes a pair of terminals for being coupled to a source of electrical energy.

12. The sample heating device of claim 8 further comprising means for regulating the temperature within said container.

13. The sample heating device of claim 12 wherein said regulating means includes a thermoelectric switch, said thermoelectric switch for monitoring the temperature within the chamber and disconnecting power supplied to said first and second heating device when the temperature within the chamber exceeds a predetermined value.

* * * * *